US005107110A

United States Patent [19]

Ishihara

[11] Patent Number: 5,107,110

[45] Date of Patent: Apr. 21, 1992

[54] SIMULTANEOUS DETECTION TYPE MASS SPECTROMETER

[75] Inventor: Morio Ishihara, Tokyo, Japan

[73] Assignee: Jeol Ltd., Tokyo, Japan

[21] Appl. No.: 672,694

[22] Filed: Mar. 18, 1991

[30] Foreign Application Priority Data

Mar. 20, 1990 [JP] Japan ..... 2-70041

[51] Int. Cl.[5] ..... H01J 49/28

[52] U.S. Cl. ..... 250/299; 250/298; 250/296; 250/294; 250/281

[58] Field of Search ..... 250/299, 298, 296, 294, 250/281, 282

[56] References Cited

U.S. PATENT DOCUMENTS

| | | | |
|---|---|---|---|
| 4,435,642 | 3/1984 | Neugebauer et al. | 250/296 |
| 4,472,631 | 9/1984 | Enke et al. | 250/281 |
| 4,638,160 | 1/1987 | Slodzian et al. | 250/296 |
| 4,924,090 | 5/1990 | Wolnik et al. | 250/296 |
| 4,998,015 | 3/1991 | Ishihara | 250/299 |
| 5,013,923 | 5/1991 | Lithe.iand et al. | 250/294 |

*Primary Examiner*—Jack I. Berman

*Attorney, Agent, or Firm*—Webb, Burden Ziesenheim & Webb

[57] ABSTRACT

There is disclosed a mass spectrometer which is equipped with a simultaneous detection-type ion detector including a microchannel plate but provides improved sensitivity. The spectrometer has an ion source, a mass analyzer for dispersing and focusing the ions introduced from the source according to their mass-to-charge ratios, three electrodes each taking the form of a flat plate, as well as the detector. The electrodes are disposed on the ion path between the mass analyzer and the detector. The electrodes produce a focusing action not in the direction in which the ions are dispersed according to their mass-to-charge ratios but in the direction perpendicular to that direction. The electrodes are spaced from each other in the direction in which the ions travel. Each electrode is provided with a rectangular hole to pass the ions. The dimension of this hole taken in the direction in which the ions are dispersed is sufficiently longer than the dimension taken in the direction perpendicular to that direction.

3 Claims, 2 Drawing Sheets

SIMULTANEOUS DETECTION TYPE MASS SPECTROMETER

FIELD OF THE INVENTION

The present invention relates to a mass spectrometer capable of multiple simultaneous detection.

BACKGROUND OF THE INVENTION

Mass spectrometers capable of multiple simultaneous detection are disclosed in U.S. Pat. Nos. 4,435,642; 4,472,631; 4,638,160; and 4,924,090. Such spectrometers are also disclosed in U.S. Pat. No. 4,998,015 and in U.S. patent application Ser. No. 07/523,588 assigned to the assignee of this application.

FIG. 1 shows one example of such a mass spectrometer capable of multiple simultaneous detection. This instrument includes an ion source 1 producing ions which are separated and focused along a focal plane l according to their mass-to-charge ratios by a mass analyzer 4 consisting of an electric field 2 and a uniform sector magnetic field 3. In order to detect the separated ions simultaneously, a simultaneous detection-type ion detector 5 having spatial resolution along the focal plane l is disposed Usually, this simultaneous detection-type ion detector 5 consists of a microchannel plate, a phosphor, and a photodiode array. The effective active surface of the greatest photodiode array presently available has a width (the dimension taken in the direction in which the ions are dispersed according to their mass-to-charge ratios) of about 50 mm, a height (the dimension taken in the direction perpendicular to the direction in which the ions are dispersed) of about 2.5 mm. However, the vertical spread of the ion beams dispersed and focused by the mass analyzer 4 is normally on the order of 10 mm at the position of the detector Therefore, the simultaneous detection-type ion detector detects only one fourth of the ions passed through the mass analyzer 4. Consequently, the sensitivity of the mass spectrometer equipped with the simultaneous detection-type ion detector is low.

SUMMARY OF THE INVENTION

It is an object of the invention to provide a mass spectrometer which is equipped with a simultaneous detection-type ion detector but provides improved sensitivity.

The above object is achieved by the teachings of the invention by a mass spectrometer having an ion source producing ions, a mass analyzer into which the ions are introduced and which disperses and focuses the ions along a focal plane according to their mass-to-charge ratios, and a simultaneous detection-type ion detector disposed along the focal plane to simultaneously detect the ions dispersed and focused by the mass analyzer. The spectrometer is characterized by the provision of a lens disposed on the ion path between the mass analyzer and the ion detector, the lens producing a focusing action not in the direction in which the ions are dispersed and focused according to their mass-to-charge ratios but in the direction perpendicular to that direction.

The strength of the lens disposed on the ion path between the mass analyzer and the ion detector is varied so that the ion beam passes through the analyzer and is directed toward the detector to impinge the effective active surface of the detector. As a result, most of the ions leaving the analyzer can be detected.

Other objects and features of the invention will appear in the course of the description thereof which follows.

DETAILED DESCRIPTION OF THE INVENTION

Figure 1:
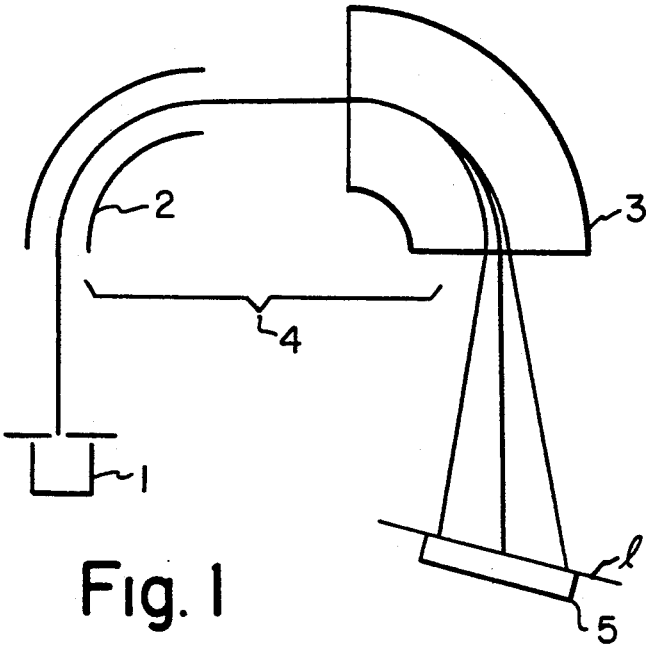
FIG. 1 is a diagram showing the ion optics of the prior art simultaneous detection-type mass spectrometer.
Figure 2A:
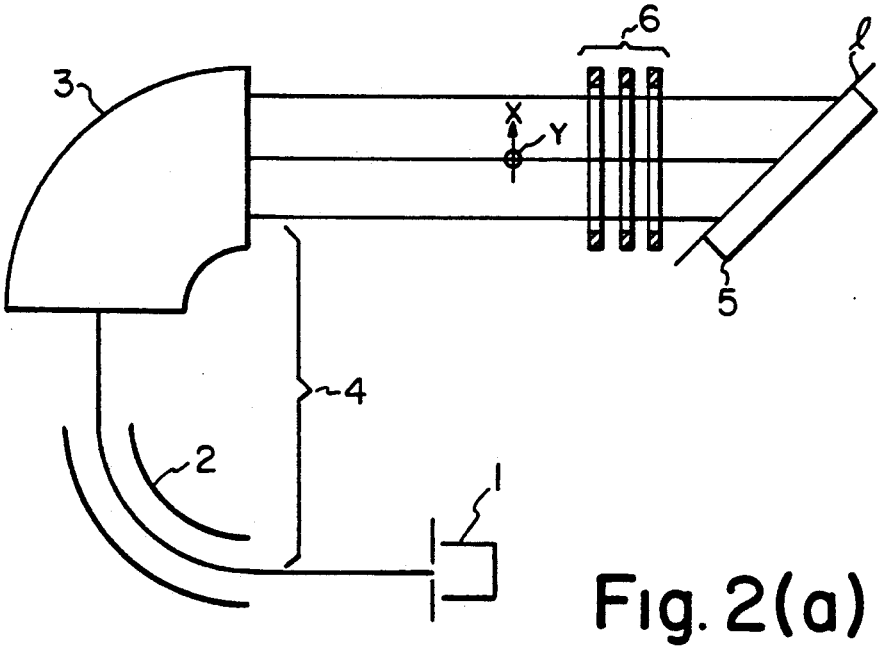
FIGS. 2(*a*) and (*b*) are diagrams showing the ion optics of a simultaneous detection-type mass spectrometer according to the invention.
Figure 2B:
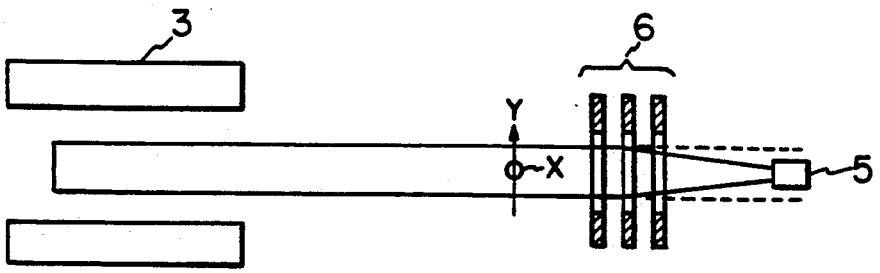

FIG. 2(*a*) shows the ion optics of a simultaneous detection-type mass spectrometer according to this invention. FIG. 2(*b*) is a diagram of the same ion optics, but viewed from a perpendicular direction. This spectrometer includes an ion source 1, a mass analyzer 4 consisting of an electric field 2 and a sector magnetic field 3 and a simultaneous detection-type ion detector 5. A lens 6 that is a kind of einzel lens is disposed on the ion path between the analyzer 4 and the detector 5.

Figure 3:
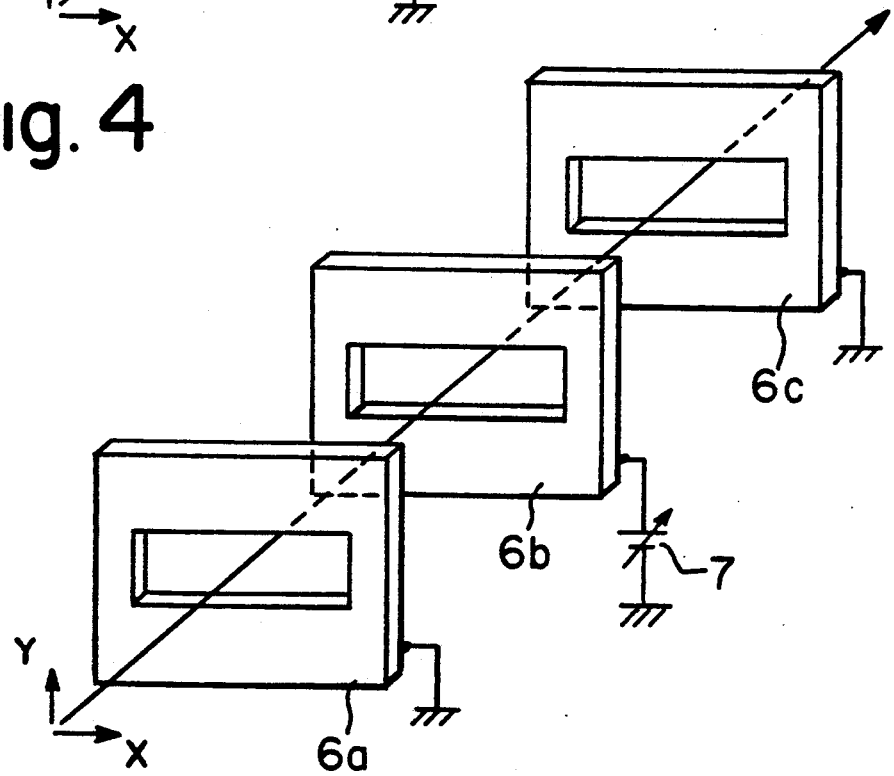

As shown in FIG. 3, the lens 6 consists of three parallel electrodes 6*a*, 6*b*, 6*c* which are regularly spaced from each other. Each electrode takes the form of a flat plate. Each of the electrodes 6*a*, 6*b*, 6*c* is provided with a rectangular hole whose longer dimension is taken in the X direction, i.e., the direction in which the ions are dispersed according to their mass-to-charge ratios, the shorter dimension being taken in the Y direction perpendicular to the X direction. The holes in the electrodes are aligned so that the ions pass through these holes successively. Where positive ions are treated by the mass analyzer 4, a power supply 7 applies a positive voltage to the central electrode 6*b*, while the other electrodes 6*a* and 6*c* are grounded. The strength of the lens 6 can be controlled by varying the voltage impressed on the electrode 6*b*.

Generally, an einzel lens comprises an electrode having a circular hole passing ions, and produces a focusing action homogeneously for all directions. Since each electrode of the lens 6 has the rectangular hole whose dimension taken in the X direction is sufficiently longer than the dimension taken in the Y direction, the focusing action of the lens in the X direction, i.e., the direction of the plane of the trajectory of the ions, is negligibly weak, but the focusing action in the Y direction perpendicular to the plane of the trajectory of the ions is sufficiently strong.

In this geometry, the positive ions emanating from the mass analyzer 4 are passed through the lens 6 and dispersed and focused along the focal plane l according to their mass-to-charge ratios The dispersed ions are detected simultaneously by the simultaneous detection-type ion detector 5

It can be seen that little focusing action of the lens 6 occurs in the X direction when the ion orbit produced at this time is observed along the X direction. Therefore, as shown in FIG. 2(*a*), the orbit of the ions is slightly varied while they pass through the lens 6. The ions then impinge on the simultaneous detection-type ion detector 5. Because the range of the masses of the dispersed ions impinging the detector is not narrowed, the resolution is not deteriorated.

We now discuss the ion orbit in the Y direction. When the lens 6 is not activated, the cross-sectional area of the ion orbit exceeds the area of the effective active surface of the ion detector, as indicated by the broken lines in FIG. 2(*b*). When a positive voltage is applied to the lens 6, the focusing action of the lens takes place only in the Y direction. At this time, as indicated by the solid lines in FIG. 2(*b*), all the ions are focused onto the effective active surface of the detector 5. Consequently, the sensitivity is improved.

Figure 4:
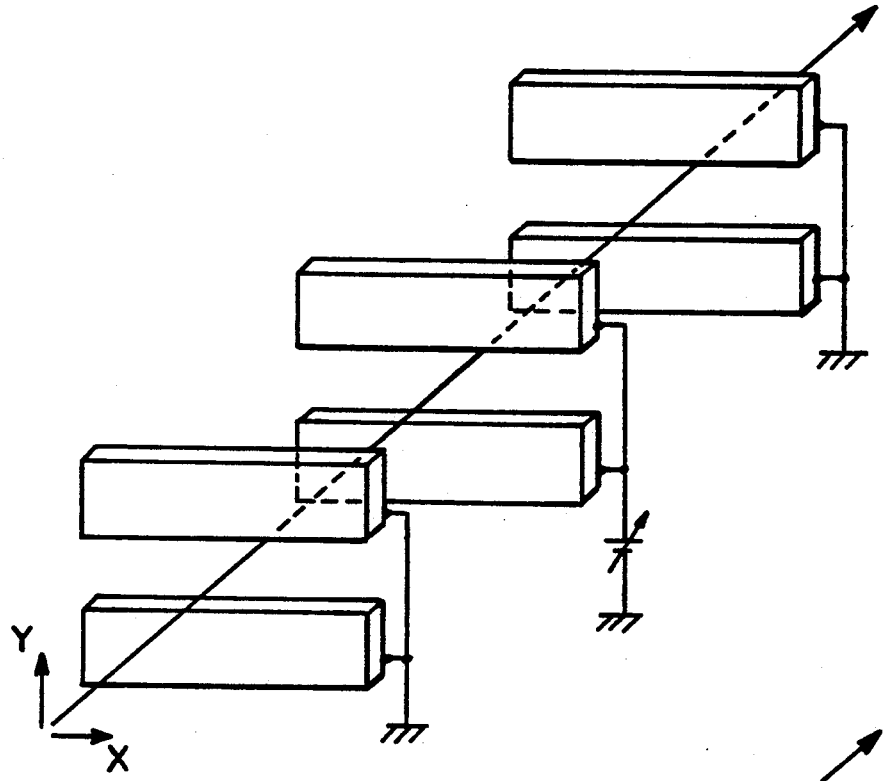
FIGS. 3 and 4 are perspective views of examples of the lens 6 shown in FIGS. 2(*a*) and (*b*).

In the above example, the lens consists of three electrodes each taking the form of a flat plate having a rectangular hole whose dimension taken in the X direction is sufficiently longer than the dimension taken in the Y direction. As shown in FIG. 4, each electrode can be divided into two. In this case, the focusing action occurring in the X direction can be reduced further. In the above example, positive ions are analyzed. Where negative ions should be analyzed, a negative voltage is applied to the electrode 6*b* by the power supply 7.

Where the invention is applied to an optical system having one or more quadrupole lenses installed on the ion path between the mass analyzer and the simultaneous detection-type ion detector, the lens means consisting of the electrodes 6*a*, 6*b*, 6*c* may be positioned at any desired location on the ion path between the analyzer and the detector.

As described in detail thus far, in the present invention, the vertical spread, or the height, of the dispersed ions is reduced to match the size of the effective active surface of the simultaneous detection-type ion detector and, therefore, ions dispersed vertically can be efficiently detected by the detector. As a result, the sensitivity of the mass spectrometer equipped with this simultaneous detection-type detector can be enhanced.

Having thus described my invention with the detail and particularity required by the Patent Laws, what is claimed and desired to be protected by Letters Patent is set forth in the following claims.

What is claimed is:

1. A mass spectrometer having an ion source producing ions, a mass analyzer into which the ions are introduced and which disperses and focuses the ions along a focal plane according to their mass-to-charge ratios, and a simultaneous detection-type ion detector disposed along the focal plane to simultaneously detect the ions dispersed and focused, said mass spectrometer comprising a lens means disposed on the ion path between the mass analyzer and the ion detector, the lens means producing a focusing action not in the direction in which the ions are dispersed and focused according to their mass-to-charge ratios but in the direction perpendicular to that direction.

2. The mass spectrometer of claim 1, wherein (A) said lens means consists of three electrodes spaced from each other in the direction in which the ions travel, each electrode taking the form of a flat plate;

(B) each electrode is provided with a rectangular hole to pass the ions, the dimension of the electrode taken in the direction in which the ions are dispersed according to their mass-to-charge ratios being longer than the dimension taken in the direction perpendicular to that direction; and (C) a voltage of the same polarity as the ions is applied to the central electrode, while the electrodes at both ends are grounded

3. The mass spectrometer of claim 2, wherein each electrode is divided into two parts which are disposed on opposite sides of the path of the ions and each of which takes the form of a flat plate.

* * * * *